US011560282B2

(12) United States Patent
Kuypers et al.

(10) Patent No.: US 11,560,282 B2
(45) Date of Patent: Jan. 24, 2023

(54) SHEET STACKER COMPRISING A SHEET FLIPPING DEVICE AND A SUPPORT DEVICE

(71) Applicant: Canon Production Printing Holding B.V., Venlo (NL)

(72) Inventors: Hermanus M. Kuypers, Venlo (NL); Lodewijk T. Holtman, Venlo (NL); Fabian T. Rosenboom, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 17/534,978

(22) Filed: Nov. 24, 2021

(65) Prior Publication Data

US 2022/0177252 A1 Jun. 9, 2022

(30) Foreign Application Priority Data

Dec. 8, 2020 (EP) ..... 20212415

(51) Int. Cl.
*B65H 29/40* (2006.01)
*B65H 31/26* (2006.01)

(52) U.S. Cl.
CPC ..... *B65H 29/40* (2013.01); *B65H 31/26* (2013.01); *B65H 2301/333* (2013.01); *B65H 2301/4212* (2013.01)

(58) Field of Classification Search
CPC ..... B65H 29/40; B65H 29/44; B65H 2301/4212; B65H 2301/333; B65H 2301/434; B65H 2301/4341; B65H 2301/44765
USPC ..... 271/186, 187, 315; 270/60
See application file for complete search history.

(56) References Cited

U.S. PATENT DOCUMENTS

| | | | | |
|---|---|---|---|---|
| 3,487,447 | A | 12/1969 | Fusco | |
| 4,228,997 | A | 10/1980 | Schoonmaker et al. | |
| 4,252,309 | A * | 2/1981 | Garrison | B65H 29/40 271/82 |
| 4,615,518 | A * | 10/1986 | Di Blasio | B65H 3/063 271/118 |
| 4,770,405 | A * | 9/1988 | Fukushima | B65H 29/40 271/187 |
| 5,026,036 | A | 6/1991 | Takahashi | |
| 5,145,167 | A | 9/1992 | McGraw et al. | |
| 5,261,655 | A | 11/1993 | Keller et al. | |
| 6,109,605 | A * | 8/2000 | Hirota | B65H 29/06 271/82 |

(Continued)

FOREIGN PATENT DOCUMENTS

| | | |
|---|---|---|
| EP | 0 200 481 A2 | 11/1986 |
| EP | 2 776 352 B1 | 8/2015 |
| EP | 3 148 908 B1 | 4/2018 |

OTHER PUBLICATIONS

European Search Report for EP 20 21 2415 dated May 21, 2021.

*Primary Examiner* — Leslie A Nicholson, III
(74) *Attorney, Agent, or Firm* — Birch, Stewart, Kolasch & Birch, LLP

(57) ABSTRACT

During flipping sheets may fold upon themselves under the influence of gravity. To prevent a sheet stacker is provided with a support device for supporting an inner surface of the sheet during flipping, the support device comprising a plurality of flexible fingers elements of different length, each configured to support a different inner area of the sheet during its flipping motion.

20 Claims, 2 Drawing Sheets

(56) References Cited

U.S. PATENT DOCUMENTS

| | | | | |
|---|---|---|---|---|
| 6,152,445 | A * | 11/2000 | Hirota | B65H 29/06 428/630 |
| 7,243,914 | B2 * | 7/2007 | Tokunaga | B65H 83/025 271/314 |
| 7,658,377 | B2 * | 2/2010 | Dobrindt | B65H 29/40 271/187 |
| 9,199,818 | B2 * | 12/2015 | Bryl | B65H 31/38 |
| 9,679,432 | B2 * | 6/2017 | Mizoro | G07D 11/16 |
| 2009/0008872 | A1 * | 1/2009 | Ryan | B65H 31/34 271/314 |
| 2011/0309566 | A1 | 12/2011 | Taniguchi et al. | |

* cited by examiner

SHEET STACKER COMPRISING A SHEET FLIPPING DEVICE AND A SUPPORT DEVICE

BACKGROUND OF THE INVENTION

1. Field of the Invention

The invention relates to a sheet stacker, a printer comprising such a sheet stacker, and a method for stacking sheets.

2. Description of Background Art

Sheet stackers, specifically those used for medium-to-large volume printers, may comprise a sheet flipping device, which reverses the orientation of the sheet during the stacking process. Such sheets stackers are known e.g. from EP 2776352 A1. It is further known that when flipping more rigid sheets, a transport belt may be positioned adjacent the flipping device to force the rigid sheets into the desired flipping motion, for example from US2011309566 AA, U.S. Pat. Nos. 5,261,655 A, 5,026,036 A, or 5,145,167 A. It was found that such configurations were not able to more reliably and stack relatively very flexible sheets, such as (long) paper sheets with low grammage or thin foils. It was found that sheets could collapse upon themselves during flipping, resulting in an undesired fold in the sheet and a disturbed sheet stack. It is further known to support the sheets during flipping by means of an air vortex, as described in e.g. EP 3148908 A1.

SUMMARY OF THE INVENTION

It is an object of the invention to provide more reliable sheet stacking, specifically one that supports a wider media range including longer and/or more flexible sheets.

In accordance with the present invention, a sheet stacker according to claim 1, a printer according to claim 13, and a method according to claim 14 are provided.

The sheet stacker according to the present invention comprises:

- a sheet flipping device for flipping a received sheet around a flipping axis with respect to an orientation wherein the sheet was received;
- a support device for supporting a surface of the sheet facing the flipping axis during the flipping of the sheet, the support device comprising a plurality of flexible fingers elements of different length, each configured to support a different inner area of the sheet during its flipping motion. As the sheet is engaged by the sheet flipping device the support device contacts and supports a portion of the sheet engaged by the flipping device, preventing the sheet from collapsing upon itself under the influence of gravity. Different lengths of the flexible finger elements allow the sheet to be support at multiple places, while also conforming to the motion of the sheet during flipping. Thereby sheets regardless of their flexibility are reliably flipped and stacked. The object of the present invention has been achieved.

More specific optional features of the invention are indicated in the dependent claims.

In an embodiment, the sheet flipping device comprises a flipping wheel provided with at least one slot for receiving the sheet. The flipping wheel is rotatable, such that the sheet with its leading edge engaged in the slot is flipped around the rotation axis of the flipping wheel. The flipping wheel may be provided with one or more slots, which may be positioned in a receiving position in time with the arrival of a sheet. This results in a highly productive system. It will be appreciated that such a flipping wheel is described in detail in EP 2776352 A1, the description of which is herein incorporated by reference.

In an embodiment, the support device is rotatable around the flipping axis. This may be achieved by the mounting the support device on the flipping wheel or by providing the support device with a rotational drive to synchronize the motion of the support device with that of the flipping wheel. In one example, the support device is mounted at the circumference of the flipping wheel. In another example, the support device is independently rotatable around the flipping axis with respect to the flipping device. The support device may be provided on a rotational body, which is rotatable by means of a drive or motor around the flipping axis. This latter drive or motor may be controlled independently from a drive or motor of the flipping device. This allows for improved support by setting or adjusting the support body in accordance with the properties of sheet to be flipped. This further allows the sheet stacker to handle a wider variety of sheet dimensions and materials.

In an embodiment, the support device is mounted on the flipping wheel. By mounting the support device on the flipping wheel a compact design is achieved. The support device may be positioned radially inward when the sheet is being receiving in the slot, such that the support device may in a position to easily engage the inner surface of the sheet during flipping, for example by allowing the support device to move radially outward. The inner surface of the sheet herein is the surface or face of the sheet facing the flipping axis. Similarly radially inward and outward are defined with respect to the flipping axis.

In an embodiment, the support device is mounted at a different radial position than the slot. The support device and the slot are offset by a predetermined angle with respect to the flipping axis. This allows the support device to be positioned outside of the path of an incoming sheet, when the flipping wheel is in a receiving position for receiving a sheet. Generally the trailing portion of the sheet requires supporting during flipping, while the leading edge of the sheet is held securely in the slot. Preferably the support device is positioned downstream of the slot in the rotational direction of the flipping wheel to allow the support device to contact and support the trailing portion of the sheet.

In an embodiment, the support device is moveable between a first position, wherein the support device is positioned outside the path of an incoming sheet which sheet is to be received by the flipping device, and a second position, wherein the support device contacts the sheet. Sheets may be supplied to the flipping device via a sheet supply path. When supporting the trailing portion of the sheet, the support device extends away from the circumference of the flipping wheel. To prevent the support device from obstructing entry of the sheet into the slot, the support device may be moved radially inward and positioned near, at, or even within the circumference of the flipping wheel when receiving a new sheet.

In an embodiment, in a first angular range corresponding to the sheet supply path, the support device is in its first, radially inward position. The support device is in its second, radially outward position in a second angular range, which corresponds to a flipping volume through which the sheet moves during flipping. Preferably, the second angular extends angularly between the sheet supply path and a sheet ejecting position, wherein the sheet is released from the flipping wheel.

In an embodiment, the sheet flipping device is moveable between a receiving position for receiving a sheet and a ejecting or release position for releasing the sheet from the sheet flipping device, wherein the support device is in the first position when the flipping device is in the receiving position and moves to in the second position when the flipping device moves from the receiving position to the ejecting position. In the receiving position the slot is aligned with a sheet supply path to allow a sheet to enter the slot. After flipping, the flipping device ejects the sheet at a predetermined position on top of a stacking surface (or on a sheet stack already present on said surface). Preferably, the ejecting position during use is below the receiving position. When the flipping device is in the receiving position, the support device is moved out of the path of the incoming sheet, preferably by moving the support device radially nearer or closer to the flipping axis and/or having the support device trailing behind the slot on the circumference of the flipping wheel. The sheet is then flipped, wherein the sheet preferably moves partially around the support device in the first position. This exposes the inner surface of the sheet to the support device, which is moved to the second position, for example by a radially outward expansion or movement. The outward movement continues as the sheets folds away from the flipping axis for continued support.

In an embodiment, each finger element preferably comprises a longitudinal body with a relatively small cross-sectional area, for example a pin, a needle, a strip, a thin sheet, etc. The finger elements may have a width in the direction of the flipping axis comparable to a (maximum) width of the applied sheets, or several finger elements may be aligned with one another along the direction of the flipping axis. The flexibility allows the finger elements to be moved between its first and second positions. Preferably, the finger elements are low weight and/or sufficiently flexible to not damage the sheet upon contact. In another embodiment, the finger elements extend in a tangential direction opposite to the rotation direction of the flipping wheel.

In an embodiment, the finger elements are configured to move radially outward as they pass through a flipping volume through which the sheet is flipped. The flipping volume is defined as the volume through which the sheet moves as it is being flipped by the flipping device. The flipping volume is preferably positioned over the stacking surface upon which the sheet flipping device may deposit its flipped sheets. With respect to the flipping axis, the flipping volume is an angular range between the sheet supply path (receiving position) and a stop element for releasing the sheet from the slot (ejecting position). The sheet partially folds during flipping and the one or more finger elements are able to move radially outward within the fold to contact and support the inner surface of the sheet. This prevents the sheet from collapsing upon itself. The radial outward motion allows the finger element to conform to the motion and dimensions of the sheet.

In an embodiment, the finger elements are configured to move radially inward outside of the flipping volume when approaching a sheet supply path for transporting sheets to the flipping device. When positioned radially inward, the fingers element are positioned in the first position and does not obstruct the path of the incoming sheet. This may be achieved by deflecting the finger element radially inward as it moves along the sheet supply path, for example by means of a guide element which urges the finger element towards the flipping axis. The guide element may be a stop block or component of the sheet supply path positioned near the flipping wheel (in the radial direction of the flipping axis). The guide element limits the available space between it and the flipping axis, forcing the at least one finger element towards the flipping axis. Thereby, the effective radius of the at least one finger element is temporarily decreased. Past the guide element, the finger element is able to radially expand or move outward into the flipping volume to support the sheet. The guide element is preferably positioned between a trajectory of a sheet on the sheet supply path and the support device and/or flipping device. In an example, the guide element is formed by the (final) transport pinch of the sheet supply path.

In an embodiment, the finger elements are elastic, such that they expand radially outward after passing by the sheet supply path. The finger elements have a predetermined elasticity or rigidity, which aids in their radially outward movement for supporting the sheet. Each finger element is sufficiently rigid to support the sheet. Limited elasticity or rigidity is required as the sheets are generally light weight. Limited elastic force further aids in a gentle contact between the finger elements and the sheet, so that damage is avoided. Preferably, one end of the finger elements is mounted to or attached to the flipping wheel, while the other end is substantially free to move radially inward and outward.

The present invention further relates to a printer comprising a sheet stacker as described in any of the above mentioned embodiments. The printer is preferably a sheet printer, and very preferably an inkjet sheet printer.

The present invention further relates a method for stacking sheets, comprising the step of flipping a sheet around a flipping axis, the step of a support device moving radially outward with respect to the flipping axis to support an inner surface of the sheet facing the flipping axis, and the step of the support device supporting the inner surface of the sheet during flipping of said sheet. The support device prevents the sheet from folding upon itself during flipping, resulting in fast and reliable flipping and stacking of sheets.

In an embodiment, the support device moves radially outward from a first, radially inward position, for example near, adjacent, at, or even within the circumference of a flipping wheel of the flipping device, during the flipping movement of the sheet, wherein the support device comprising a plurality of flexible fingers elements of different length, each supporting a different inner area of the sheet during its flipping motion. The support device in a first position is located radially adjacent the circumference of the flipping so as not to obstruct entry of the sheet into the flipping wheel. Having received the sheet, the flipping wheel commences its flipping action, which flips the sheet, for example by rotating the engaged leading edge of the sheet around the flipping axis. During that motion the trailing portion of the sheet moves radially outward in consequence of the sheet's rigidity, elasticity, and/or centrifugal forces acting upon said portion. The support device moves radially outward, following the outward expansion or folding of the sheet, to engage the inner surface. Basically, the support device moves into the inner volume of the folding sheet to prevent the fold from collapsing upon itself. Preferably, the method further comprises a step of moving the plurality of flexible fingers of the support device radially outward through an inner volume of the folding sheet to engage the inner surface and to limit the folding movement and/or a step of moving the plurality of flexible fingers of the support device moves radially inward, such that the plurality of flexible fingers do not pass through a trajectory of a sheet being fed from a sheet supply into a flipping device. In a preferred embodiment, the step of flipping the sheet comprises rotating the flipping device.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
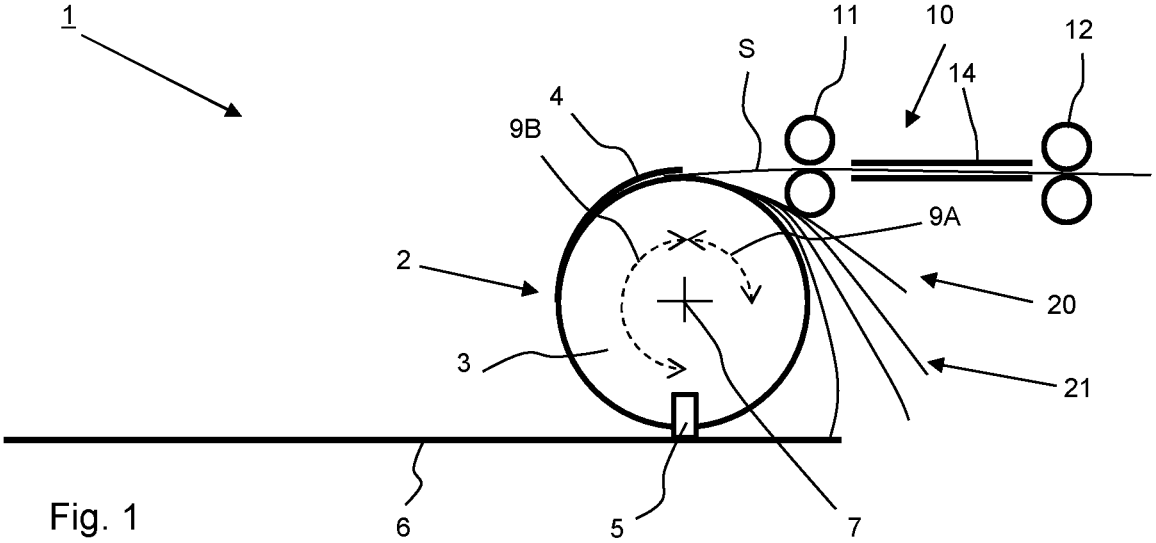
FIG. 1 is a schematic cross-sectional side view of the sheet stacker according to the present invention when receiving a sheet.

The present invention will now be described with reference to the accompanying drawings, wherein the same reference numerals have been used to identify the same or similar elements throughout the several views.

FIG. 1 illustrates a schematic cross-sectional side view of a sheet stacker 1 according to the present invention. The sheet stacker 1 comprises a sheet flipping device 2. The sheet flipping device 2 comprises a flipping wheel 3 rotatable around the flipping axis 7. A slot 4 is provided on the circumference of the flipping wheel 3 to receive sheets S from the sheet supply path 10. When the leading edge of the sheet S is engaged in the slot 4, the flipping wheel 3 is rotated, bringing the engaged leading edge against the stop element 5. The stops element 5 is positioned besides the flipping wheel 3 or multiple stop elements 5 may be present in the between multiple flipping wheels 3 in the direction of the flipping axis 7. Contact with the stop element 5 causes the sheet S to be released from the slot 4. The trailing portion of the sheet S continues to be fed into the flipping volume by the transport devices 11, 12 of the sheet supply path 10. This causes the sheet S to fold and flip. The support device 20 which is formed of a plurality of flexible finger elements 21 is mounted on the flipping wheel 3 at a predetermined angle from the slot 4.

In FIG. 1, the flipping wheel 3 is positioned in its receiving position, which aligns the slot 4 with the sheet supply path 10. By means of the transport devices 11, 12 a sheet S is moved via the guides 14 towards and into the slot 4. The flipping wheel 3 during insertion may be stationary or move at a reduced speed, which allows the sheet S to move into the slot 4. Between the sheet supply path 10 and the flipping axis 7, the support device is forced into its first position by contact with the sheet supply path 11. The bottom roller of the transport pinch 11 in FIG. 1 acts as a guide element, which urges or presses the finger elements 21 radially inwards towards the circumference of the flipping wheel 3. The guide element ensures that the support device 20 is in its first, radially inward position while in the first angular range 9A. It will be appreciated that such a guide element may be embodied in other forms, such as a guide plate or block, either as part of the sheet supply path 10 or as a separate unit. This radially inward urging combined with the radially offset position of the support device 20 with respect to the slot 4 moves the support device 4 out of the way of sheets S which are transferred from the sheet supply path 10 to the slot 4.

Figure 2:
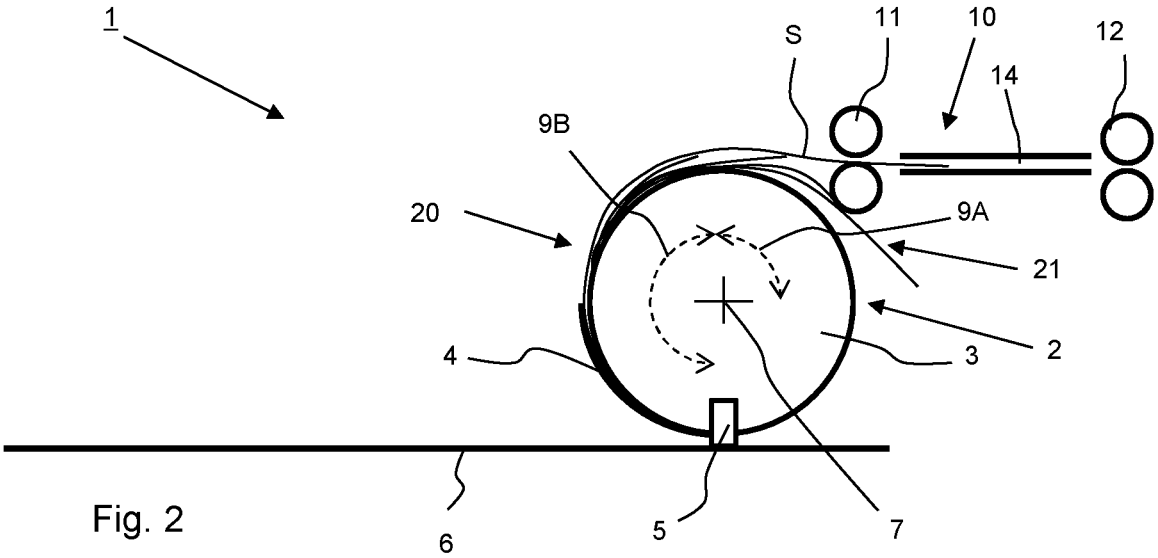
FIG. 2 is a schematic cross-sectional side view of the sheet stacker of FIG. 1 with the leading edge of the sheet at its ejecting position.

FIG. 2 illustrates the flipping wheel 3 bringing the leading of the sheet S against the stop element 5. With respect to FIG. 1 the flipping wheel 3 is rotated a predetermined angle, in this example roughly 90°, towards the ejecting position shown in FIG. 2. The leading edge of the sheet S is held by the slot 4 and consequently rotated against the stop element 5. The transport devices 11, 12 are operated at sufficient velocity such that the trailing portion of the sheet S follows the leading edge. Engagement with the stop element 5 causes the sheet S to be released from the slot 4. The slot 4 passes by the stop element 5, allowing the flipping wheel 3 to continue its rotation back to the receiving position.

The support device 20 follows the slot 4 and moves into the second angular range 9B, which corresponds to the flipping volume through which sheets S are flipped. The finger elements 21 having past the guide element, which urges them towards the circumference of the flipping wheel start to expand radially outward. At least the free ends of the finger elements 21 move against the inner surface of the sheet S. Further radial outward movement of the finger elements 21 may be limited, as the trailing portion of the sheet S may still be engaged by the transport device 11. After the leading edge of the sheet S is stopped against the stop element 5, the transport device 11 continues to feed the trailing portion into the flipping volume of the flipping device 2. This results in a fold being formed in the sheet S, which fold moves away from the flipping axis 7 as more of the trailing portion passes by the transport device 11.

Figure 3:
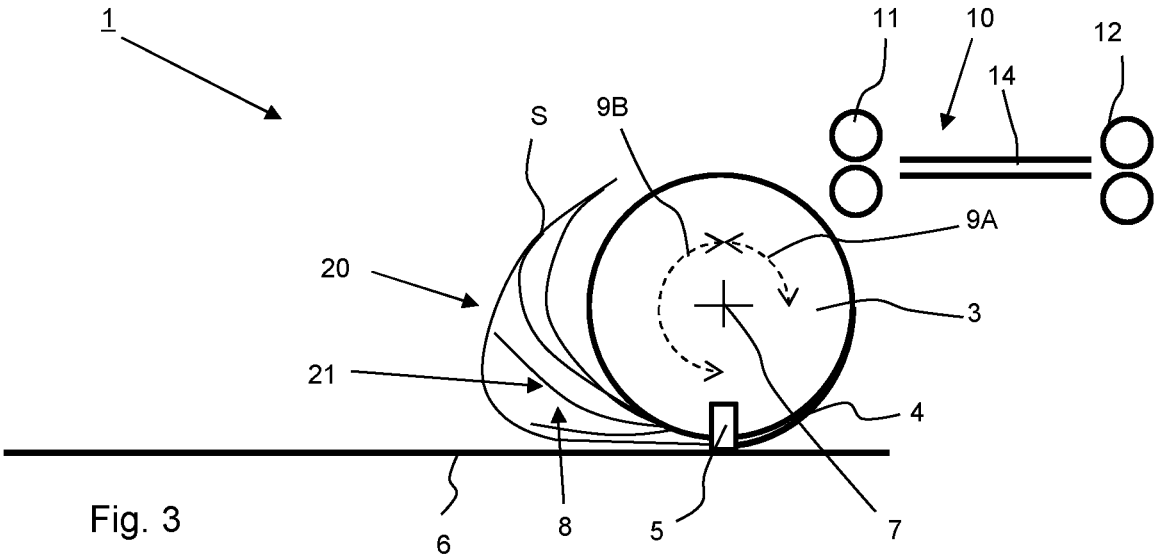
FIG. 3 is a schematic cross-sectional side view of the sheet stacker of FIG. 1 with the support device supporting the sheet.

FIG. 3 illustrates the release of the trailing portion of the sheet S from the transport device 11. The sheet S in this example is very flexible, for example formed of low grammage paper or a thin plastic foil. Instead of rolling away from the flipping axis 7 and completing the flipping motion, the fold in such flexible sheets S tends to cause such sheets S collapse upon themselves under the influence of gravity. This is prevented by the finger elements 21 which are moved further radially outward due to the continued rotation of the flipping wheel 3. The finger elements 21 may be formed as long strips, sheets, rods, etc. The finger elements 21 extend tangentially backwards from the circumference of the flipping wheel 3. The finger elements 21 expand radially outward inside the inner volume 8 inside the fold of the sheet S. The finger elements 21 are preferably sufficiently flexible such that these are moved outward by the centrifugal forces. The finger elements 3 may further be provided with a certain rigidity or elasticity which aids in their outward movement after passing the guide element. As the sheets S are generally low weight relatively small forces are required for effectively supporting the sheet S. This allows the finger elements 21 to be formed of low costs materials. The flexibility allows the finger elements 21 to easily conform to the fold shape of the sheet S, which fold shape may vary dependent on sheet dimensions and materials. The flexibility further allows the finger elements 21 to pass between the flipping wheel 3 and the stacking surface 6 at the stop element 5. This allows existing sheet stackers to be updated with such a support device with little to no changes to the existing hardware.

In the second angular range 9B between the receiving position and the ejecting position, the finger elements are in their second position, which is more radially outward as compared to their first position at the guide element, which urges the finger elements 21 towards or against the circumference of the flipping wheel 3 in the first angular range 9A. Similarly, the finger elements are urged into their first, radially inward position by the stacking surface, as the finger elements 21 pass by the stop element 5. Allowing the finger elements 21 to move radially outward during the flipping of the sheet S, allows for a compact solution, which does not increase the overall dimensions of the sheet stacker 1.

Figure 4:
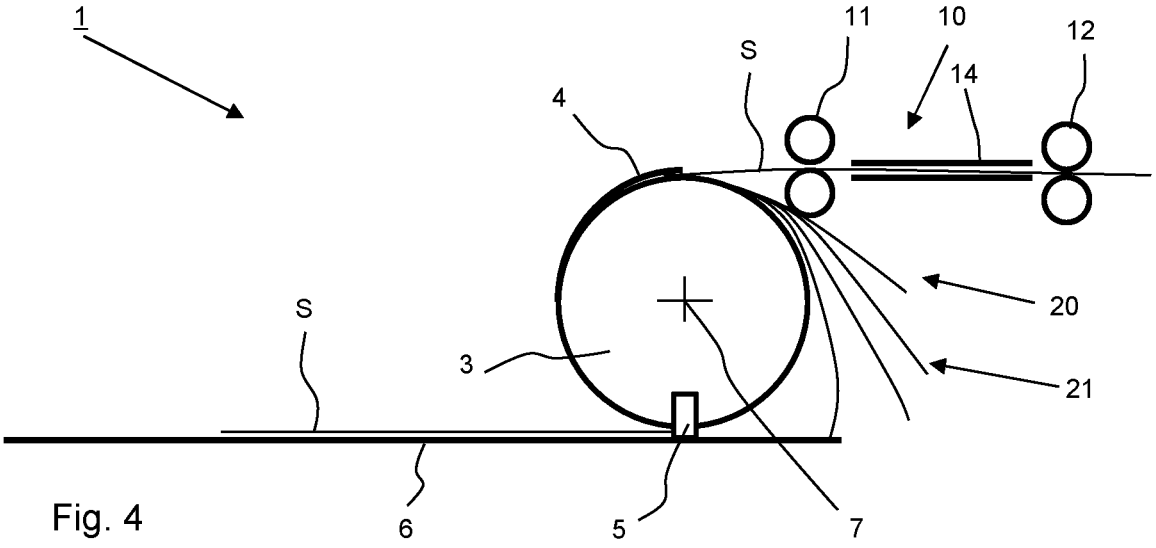
FIG. 4 is a schematic cross-sectional side view of the sheet stacker of FIG. 1 when receiving a further sheet after stacking the sheet.

FIG. 4 illustrates the sheet S being flipping and positioned on the sheet stacking surface 6. The flipping wheel 3 has rotated to its receiving position as shown in FIG. 1. A further sheet S may be received into the slot 4 and stacked on top of the flipped sheet S to form a sheet stack.

Figure 5:
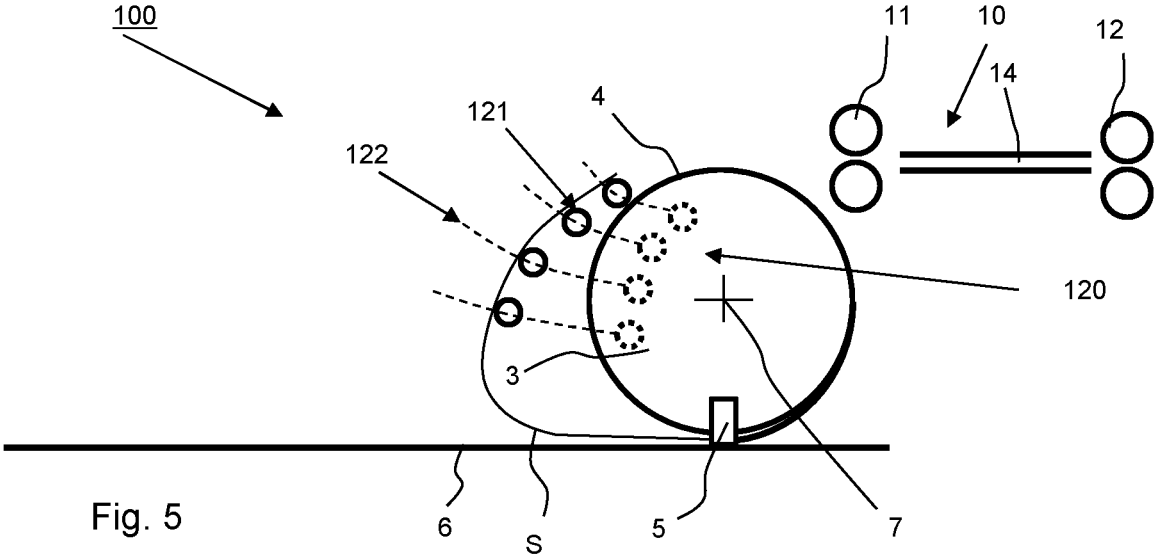
FIG. 5 is a schematic cross-sectional side view of another embodiment of the sheet stacker according to the present invention.

FIG. 5 illustrates another embodiment of a sheet stacker 100 according to the present invention. It will be appreciated that similar components as in FIGS. 1 to 4 are indicated with similar reference numbers and will not be discussed in detail here again. The support device 120 in FIG. 5 is formed of a plurality of support bodies 121, with each support body being moveable along its predetermined path 122 from a radially inward position (indicated with the dashed contours) to a radially outward position, as shown in FIG. 5. When receiving a sheet S the support bodies 121 are positioned out of the trajectory of the incoming sheet S at their radially inward positions within the circumference of the flipping wheel 3. During flipping as the fold is formed in the sheet S, the support bodies 121 are moved with appropriate speed and timing to come into contact with the inner surface of the sheet S to prevent the sheet S from folding upon itself. The support bodies 121 may be moved along their paths 122 by arms or guides. For example, an actuator may be provided in between neighboring flipping wheels 3, which extends into the inner volume of the sheet S.

Figure 6:
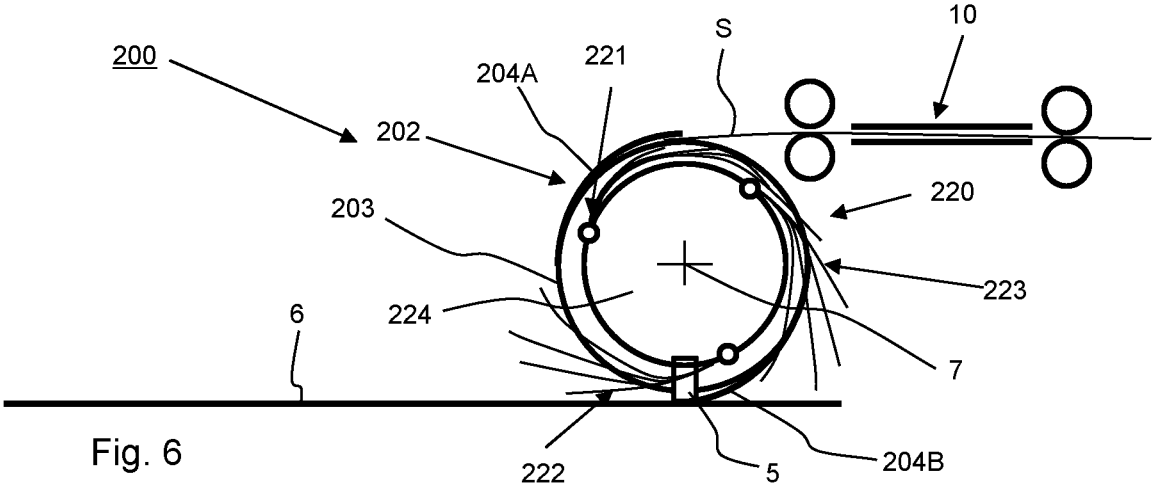
FIG. 6 is a schematic cross-sectional side view of a further embodiment of the sheet stacker according to the present invention.

FIG. 6 shows a further embodiment of a sheet stacker 200 according to the present invention. In contrast to FIGS. 1 to 5, the support device 220 in FIG. 6 is provided on its own rotational body 224 and not directly on the flipping device 202. The rotational body 224, which is formed as a wheel 224, is rotational around the flipping axis 7 independent of the flipping wheel 203. The rotational position and/or speed of the rotational body 224, and thus of the support device 220, may be controlled differently from those of the flipping wheel 203. A first drive or motor (not shown) is provided to control the rotation of the flipping wheel 203 and a second drive or motor (not shown) is provided to rotate the support device 220.

The flipping wheel 203 is similar to those in FIGS. 1 to 5, but with the addition of a second slot 204B. The first and second slots 204A, 204B are angularly offset, in this example by 180°, though any number of slots may be applied within the context of the present invention. The support device 220 comprises a plurality of finger elements 221, 222, 223, which in this example are embodied in groups 221, 222, 223 which are distributed along the circumference of the rotational body 224. In FIG. 6, three finger element groups 221, 222, 223 are distributed at 120° with respect to one another, though any suitable number of groups may be applied. The number of finger element groups 221, 222, 223 may be the same or different from the number of slots 204A, 204B on the flipping wheel 203. The angle in this case is measured from a mounting of each finger element group 221, 222, 223 on the rotational body 224. The number of groups, positions, materials, and dimensions of the finger elements 221, 222, 224 are selected in accordance with the properties of the sheets to be stacked, the dimensions of the flipping wheel 202, and/or the dimensions of the rotational body 224.

Independent control of the movement of the support body 220 with respect to that of the flipping device 202 allows the finger elements 221, 222, 223 to be more accurately positioned where support is needed under the sheet S. It further aids in improving the media range of the sheets to be stacked to achieve handling of a wider variety of sheet dimensions and materials. Such independent control also allows the support body to be positioned in an angular position out of the way of the incoming sheet with use of a guide element. After insertion of the sheet into the slot 204A, 204B, the rotational body may be suitably accelerated to position the finger elements 221, 222, 223 under the trialing portion of the sheet S, as the sheet S begins to fold outward.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sheet stacker comprising:

a sheet flipping device for flipping a received sheet around a flipping axis with respect to an orientation wherein the sheet was received, the sheet flipping device comprising a flipping wheel provided with at least one slot defined by a receiving element and a circumferential surface of the flipping wheel and for receiving the sheet between the receiving element and the circumferential surface of the flipping wheel;

a support device for supporting a surface of the sheet facing the flipping axis during the flipping of the sheet, the support device comprising a plurality of flexible fingers elements of different length, each configured to support a different inner area of the sheet during its flipping motion, wherein the slot is separated from the plurality of flexible fingers.

2. The sheet stacker according to claim 1, wherein the support device rotatable around the flipping axis.

3. The sheet stacker according to claim 2, wherein the support device is at a different angular position than the slot.

4. The sheet stacker according to claim 1, wherein the support device is rotatable around the flipping axis independently from the flipping device.

5. The sheet stacker according to claim 1, wherein the flexible fingers elements of the support device are moveable between a first position, wherein the support device is positioned outside the path of an incoming sheet which sheet is to be received by the flipping device, and a second position, wherein the support device contacts the sheet.

6. The sheet stacker according to claim 5, wherein the flipping device is moveable between a receiving position for receiving a sheet and a ejecting position for releasing the sheet from the flipping device, wherein the support device is in the first position when the flipping device is in the receiving position and moves to the second position when the flipping device moves from the receiving position to the ejecting position.

7. The sheet stacker according to claim 6, further comprising a guide element positioned between a trajectory of a sheet on a sheet supply path and the support device, such that contact between the support device and the guide element moves the flexible finger element radially inwards, wherein the guide element is positioned such that a trajectory of a sheet from the sheet supply path into the flipping device in the receiving position is unobstructed by the support device.

8. The sheet stacker according to claim 7, wherein a stop element is formed by a transport pinch of the sheet supply path.

9. The sheet stacker according to claim 1, wherein the finger elements are configured to move radially outward as it passes through a flipping volume through which the sheet is flipped.

10. The sheet stacker according to claim 9, wherein the finger elements are configured to move radially inward outside of the flipping volume when approaching a sheet supply path for transporting sheets to the flipping device.

11. The sheet stacker according to claim 10, wherein the finger elements are elastic, such that they expand radially outward after passing by the sheet supply path.

12. The sheet stacker according to claim 9, wherein further comprising a guide element positioned between a trajectory of a sheet on the sheet supply path and the support device, such that contact between the support device and the guide element moves the flexible finger element radially inwards.

13. A printer comprising a sheet stacker according to claim 1.

14. The sheet stacker according to claim 1, wherein the plurality of flexible fingers are made of material that is flexible and different from the receiving element defining the slot.

15. The sheet stacker according to claim 1, wherein the plurality of flexible fingers and the slot are respectively provided on different angular positions with respect to the flipping axis.

16. The sheet stacker according to claim 1, wherein the plurality of flexible fingers are positioned downstream of the slot in a rotational direction of the flipping wheel to allow the plurality of flexible fingers to contact and support the sheet after the sheet is received in the slot, and wherein every two immediately adjacent flexible fingers of the plurality of flexible fingers angularly overlap with each other with respect to the flipping axis.

17. A method for stacking sheets, comprising the steps of:

flipping a sheet on a flipping wheel of a sheet flipping device around a flipping axis, the flipping wheel being provided with at least one slot defined by a receiving element and a circumferential surface of the flipping wheel and for receiving the sheet between the receiving element and the circumferential surface of the flipping wheel;

a support device moving radially outward with respect to the flipping axis to support an inner surface of the sheet facing the flipping axis;

the support device supporting the inner surface of the sheet during flipping of said sheets, wherein the support device comprising a plurality of flexible fingers elements of different length, each supporting a different inner area of the sheet during its flipping motion, and wherein the slot is separated from the plurality of flexible fingers.

18. The method according to claim 17, comprising the step of moving the plurality of flexible fingers of the support device radially outward through an inner volume of the sheet to engage the inner surface of the sheet and to prevent the sheet from folding upon itself.

19. The method according to claim 18, further comprising the step of moving the plurality of flexible fingers of the support device radially inward, such that the plurality of flexible fingers do not pass through a trajectory of a sheet being fed from a sheet supply into the flipping device.

20. The method according to claim 19, wherein the step of flipping the sheet comprises rotating the flipping device.

* * * * *